United States Patent [19]

Kleykamp

[11] Patent Number: 4,684,418

[45] Date of Patent: Aug. 4, 1987

[54] METHOD OF MAKING A HOLDDOWN BAR FOR A HATCH COVER OF A RAILROAD CAR

[75] Inventor: Donald L. Kleykamp, Washington Township, Montgomery County, Ohio

[73] Assignee: Dayco Products, Inc., Dayton, Ohio

[21] Appl. No.: 861,167

[22] Filed: May 9, 1986

Related U.S. Application Data

[62] Division of Ser. No. 459,067, Jan. 19, 1983, abandoned.

[51] Int. Cl.[4] ..... B32B 31/16

[52] U.S. Cl. ..... 156/91; 105/377; 156/242; 220/314; 220/315; 264/274

[58] Field of Search ..... 49/490, 491, 493; 105/377; 156/91, 242; 220/314, 315; 264/274

[56] References Cited

U.S. PATENT DOCUMENTS

| | | | |
|---|---|---|---|
| 4,239,008 | 12/1980 | Conlon | 105/377 |
| 4,594,949 | 6/1986 | Kleykamp | 105/377 |
| 4,601,245 | 7/1986 | Kleykamp | 105/377 |
| 4,602,568 | 7/1986 | Kleykamp et al. | 105/377 |
| 4,602,569 | 7/1986 | Kleykamp | 105/377 |

*Primary Examiner*—Robert A. Dawson

*Attorney, Agent, or Firm*—Joseph V. Tassone

[57] ABSTRACT

A holddown bar for a hatch cover of a railroad car or the like and having opposed ends one of which is adapted to be pivotally mounted to the car and the other of which is adapted to be releasably latched to the car while a medial portion thereof intermediate the opposed ends is adapted to extend across the hatch cover and carries a sealing gasket in a channel thereof that is adapted to engage against the hatch cover. The channel is defined by a surface of the holddown bar and the gasket is secured to the surface by adhesive disposed between the surface and the gasket and being directly secured to the gasket and to the surface by the adhesive characteristics of the adhesive. An interlocking member is carried by the holddown bar and has a first part thereof mechanically interlocked to the holddown bar and a second part thereof mechanically interlocked to the adhesive to thereby mechanically interlock the adhesive to the holddown bar.

6 Claims, 23 Drawing Figures

METHOD OF MAKING A HOLDDOWN BAR FOR A HATCH COVER OF A RAILROAD CAR

CROSS REFERENCE TO RELATED APPLICATION

This application is a divisional patent application of its copending parent patent application, Ser. No. 459,067, filed Jan. 19, 1983, now abandoned.

BACKGROUND OF THE INVENTION

1. Field of the Invention

This invention relates to an improved holddown bar for a hatch cover of a railroad car or the like and to a method of making the same as well as to a railroad car utilizing such a holddown bar.

2. Prior Art Statement

It is known to applicant to provide a holddown bar for a hatch cover of a railroad car or the like, the holddown bar having opposed ends one of which is adapted to be pivotally mounted to the car and the other of which is adapted to be releasably latched to the car while a medial portion thereof intermediate the opposed ends is adapted to extend across the hatch cover and carries a sealing gasket in a channel thereof that is adapted to engage against the hatch cover, the channel being defined by a surface of the holddown bar and the gasket being secured to that surface by adhesive disposed between the surface and the gasket.

For example, see FIGS. 1-16 of this application which disclose part of the subject matter of the copending patent application, Ser. No. 412,416, filed Aug. 27, 1982.

SUMMARY OF THE INVENTION

It is one feature of this invention to provide an improved holddown bar for a hatch cover of a railroad car or the like wherein the holddown bar has improved means for securing the sealing gasket thereof in the channel thereof.

In particular, it is believed according to the teachings of this invention that an interlocking member can be carried by the holddown bar to interlock the adhesive in the channel thereof to the holddown bar to overcome the problem of bonding the adhesive to the surface of the holddown bar as the adhesive will only readily bond to the gasket whereby it is believed that the gasket will remain secured in the channel of the holddown bar of this invention.

For example, one embodiment of this invention provides a holddown bar for a hatch cover of a railroad car, the holddown bar having opposed ends one of which is adapted to be pivotally mounted to the car and the other of which is adapted to be releasably latched to the car while a medial portion thereof intermediate the opposed ends is adapted to extend across the hatch cover and carries a sealing gasket in a channel thereof that is adapted to engage against the hatch cover. The channel is defined by a surface of the holddown bar and the gasket is secured to that surface by adhesive disposed between the surface and the gasket. An interlocking member is carried by the holddown bar and has a first part thereof mechanically interlocked to the holddown bar and a second part thereof mechanically interlocked to the adhesive to thereby mechanically interlock the adhesive to the holddown bar whereby the interlocking member assists the adhesive in securing the gasket in the channel of the holddown bar.

Accordingly, it is an object of this invention to provide an improved holddown bar for a hatch cover of a railroad car or the like, the holddown bar of this invention having one or more of the novel features of this invention as set forth above or hereinafter shown or described.

Another object of this invention is to provide an improved method of making such a holddown bar, the method of this invention having one or more of the novel features of this invention as set forth above or hereinafter shown or described.

Another object of this invention is to provide an improved railroad car having a holddown bar of this invention, the railroad car of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
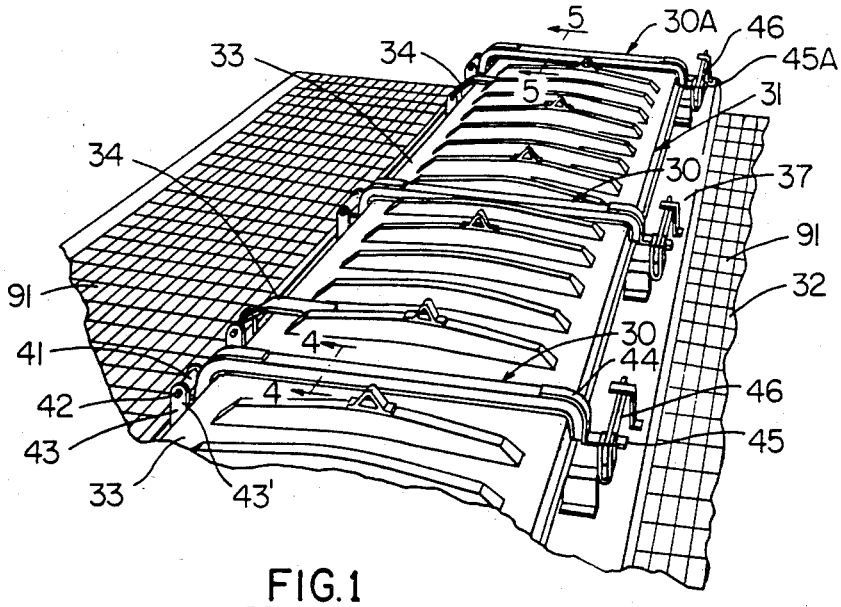
FIG.1 PRIOR ART
FIG. 1 is a fragmentary top perspective view of a railroad car having holddown bars for the hatch covers thereof, FIG. 1 illustrating prior art holddown bars.

While the various features of this invention are hereinafter illustrated and described as providing a holddown bar for a certain type of hatch cover of a railroad car, it is to be understood that the various features of this invention can be used singly or in any combination thereof to provide a holddown bar for other structures as desired.

Therefore, this invention is not to be limited to only the embodiments illustrated in the drawings, because the drawings are merely utilized to illustrate one of the wide variety of uses of this invention.

It is believed that in order to fully describe the various features of this invention, a detailed disclosure of the prior art structure should be first set forth.

Figure 2:
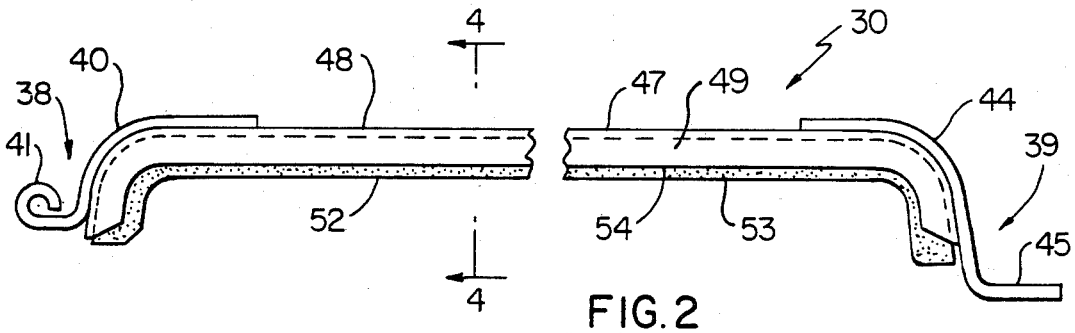
FIG.2 PRIOR ART
FIG. 2 is an enlarged side view of one of the prior art holddown bars of FIG. 1.
Figure 3:
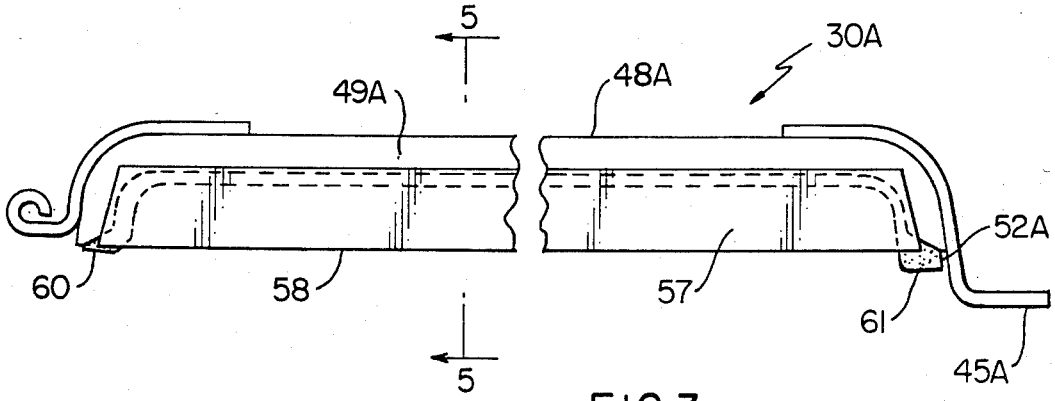
FIG.3 PRIOR ART
FIG. 3 is an enlarged side view of another of the prior art holddown bars of FIG. 1.
Figure 4:
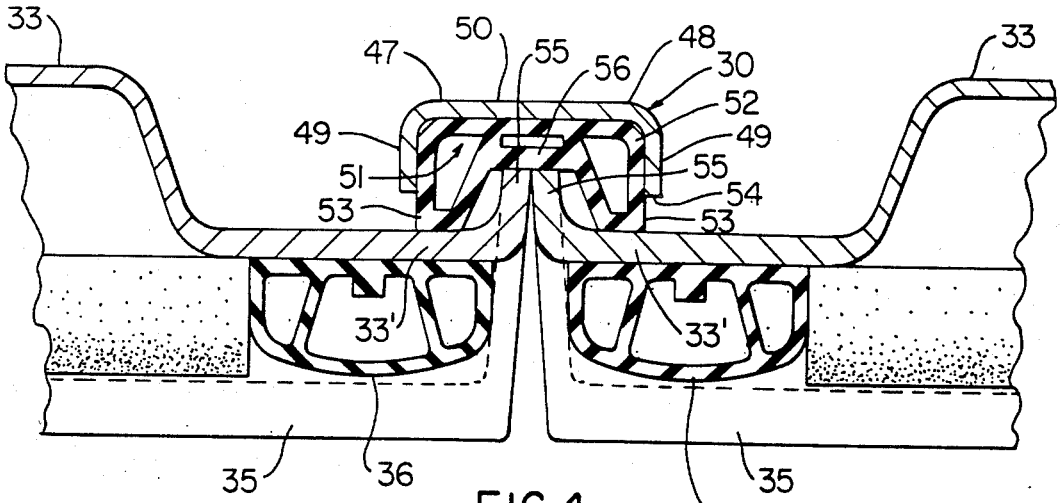
FIG.4 PRIOR ART
FIG. 4 is an enlarged fragmentary cross-sectional view taken on line 4—4 of FIG. 2 as well as on line 4—4 of FIG. 1.
Figure 5:
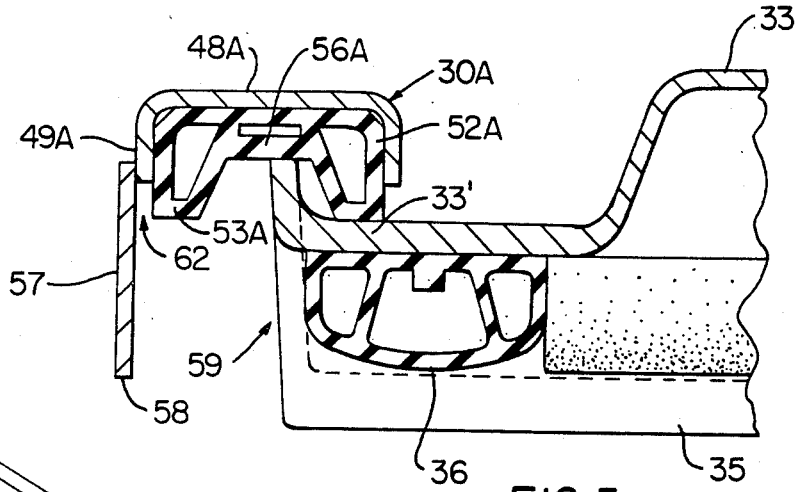
FIG.5 PRIOR ART
FIG. 5 is an enlarged fragmentary cross-sectional view taken on line 5—5 of FIG. 3 as well as on line 5—5 of FIG. 1.

Accordingly, referring now to FIGS. 1–5, one prior known holddown bar for a hatch cover of a railroad car is generally indicated by the reference numeral 30 in FIGS. 1, 2 and 4 while another prior known holddown bar is generally indicated by the reference numeral 30A in FIGS. 1, 3 and 5, the prior known holddown bars 30 and 30A being illustrated in FIG. 1 as holding closed the hatch cover unit 31 of a conventional railroad car 32.

Each hatch cover 33 of the hatch cover unit 31 has a peripheral flange 35 carrying sealing gaskets 36 which are adapted to be disposed in sealing relation against the hatch opening flange 37 and be held in sealing engagement therewith by the holddown bars 30 and 30A in a manner well known in the art to fully close the hatch opening (not shown) in the top of the railroad car 32.

The prior known holddown bar 30 has opposed ends 38 and 39 with the end 38 comprising a metal plate 40 that is formed to define a tubular part 41 that is adapted to be pivotally mounted to a pivot pin 42 of a bracket 43 carried by the railroad car 32 in a manner well known in the art whereby the holddown bars 30 are adpated to pivot on the pivot pin 42 and between the upstanding side flanges 43′ of the bracket 43.

Each prior known holddown bar 30 has the other end 39 thereof formed from a metal plate 44 so shaped that the same defines a toe or latch plate 45 which is adapted to be releasably latched to the car 32 by suitable latch member 46 extending over the same as illustrated in FIG. 1 in a manner well known in the art whereby a medial portion 46 of the holddown bar 30 will extend across the respective hatch cover 33 or covers 33 to sealingly engage thereagainst and hold the respective hatch cover 33 or covers 33 in sealing relation against the hatch opening flange 37 of the railroad car 32 in a manner well known in the art.

The medial portion 47 of each holddown bar 30 comprises a metal channel member 48 having a pair of spaced parallel legs 49 and a cross member 50 that define a channel 51 which receives a resilient sealing gasket 52 therein which has side portions 53 that extend outboard of the bottom edges 54 of the legs 49 of the U-shaped channel member 48 as illustrated in FIGS. 2 and 4 so as to sealingly engage directly against the hatch cover 33 or covers 33. For example, FIG. 4 illustrates the holddown bar 30 spanning and engaging the adjacent upstanding end flanges 55 at the adjacent ends 33′ of the hatch covers 33 with a central section 56 of the gasket 52 while the side portions 53 of the gasket 52 sealingly engage against the respective covers 33 inboard of the flanges 55 thereof as illustrated in FIG. 4. In this manner, not only are the adjacent ends 33′ of the two hatch covers 33 held in a sealing closed condition against the hatch opening flange 37 by the holddown bar 30 of FIG. 4, but also the gasket 52 of the holddown bar 30 seals the adjacent flanges 55 to each other.

As illustrated in FIG. 1, at least one other holddown bar 30 is provided on the railroad car 32 for each hatch cover 33 and is disposed intermediate the opposed ends 33′ of the respective hatch cover 33 to engage against such hatch cover 33 and hold the same in its closed condition against the hatch opening flange 37.

The metal end plates 40 and 44 that define the opposed ends 38 and 39 of each holddown bar 30 are secured to the metal channel member 48, such as by welding or the like, and the sealing gasket means 52, which is formed of rubber or the like, is secured in the channel 51 of the channel member 48 by a suitable adhesive or the like. The surfaces of the metal parts of the holddown bar can be provided with protective coatings or the like.

Each holddown bar 30A is formed in substantially the same manner as the holddown bar 30 previously described whereby like parts are indicated by like reference numerals followed by the reference letter "A".

As illustrated in FIGS. 3 and 5, each holddown bar 30A is formed identical to the holddown bar 30 previously described except that the same has a metal side plate 57 welded to the particular leg 49A of the channel member 48A so as to have its lower edge 58 extend closely adjacent the hatch flange 37 of the car 32 as illustrated in FIG. 5 so as to tend to protect the particular end 33′ of the hatch cover 33 that is exposed to the elements at each end of the railroad car 32 in the area of the reference numeral 59 in FIG. 5 whereby the two end holddown bars 30A for each railroad car 32 have the side plates 57 on different legs 49 of their respective channel member 48. Such side plate 57 is hereinafter referred to as a "rain shield" but it is of course to be understood that the same shields the protected hatch even from other elements of the weather than just rain.

However, it was found according to the teachings of the invention set forth in the copending patent application, Ser. No. 412,416, filed Aug. 27, 1982, that not only are the opposed ends 60 and 61 of the gasket 52A of each holddown bar 30A exposed to the elements as illustrated in FIG. 3 even though the side plate 57 is being utilized, but also the sealing gasket 52A of each holddown bar 30A as illustrated in FIG. 5 has an area in the region of the reference numeral 62 subjected to wind, ice, snow, etc. which tend to start gasket tear and, thus, early wear out of the sealing gasket 52A. In addition, it is believed that the sharp metal edges on the U-shaped channel member 48A tend to cause cutting of the gasket 52A and, thus, also early wear out thereof.

It can readily be seen from FIG. 1 that the hatch covers 33 are adapted to be latched in the closed position by the holddown bars 30 and 30A having the latch toes 45 and 45A thereof held in the latched position by the latches 46 whereby the sealing gaskets 36 of the covers 33 are held in sealing relation against the hatch opening flange 37 until it is desired to open the hatch covers 33.

In particular, in order to open a particular hatch cover 33, the latches 46 for the holddown bars 30 and 30A for that particular hatch cover 33 are opened so that the holddown bars 30 and 30A can be pivoted on their pivot ends 38 at the brackets 43 in a manner to be out of the way of the particular hatch cover 33 so that that particular hatch cover 33 can be opened on its hinge structure 34 in a manner conventional in the art.

Figure 6:
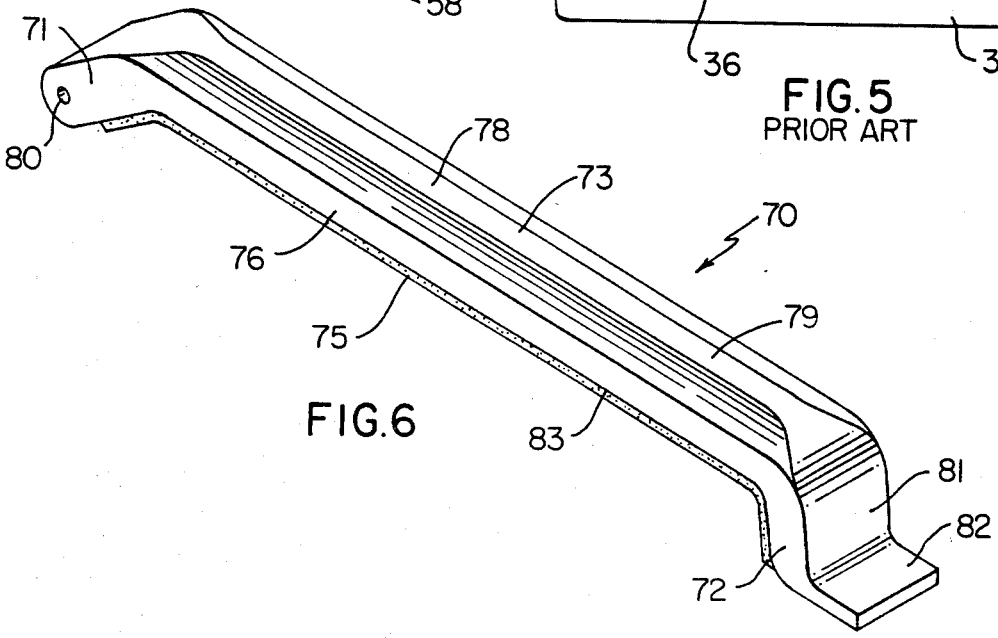
FIG. 6 is a top perspective view of one of the improved prior known holddown bars of the invention of the copending patent application, Ser. No. 412,416, filed Aug. 27, 1982.

As previously stated, it was found according to the teachings of the invention set forth in the copending patent application, Ser. No. 412,416, filed Aug. 27, 1982, that the prior known substantially all metal holddown bars 30 and 30A can be replaced by the uniquely formed holddown bars of that invention that are generally indicated by the reference numeral 70 in FIG. 6 and 70A in FIG. 11, the holddown bars 70 of FIG. 6 to replace the intermediate holddown bars 30 of FIG. 1 and the holddown bars 70A of FIG. 11 to replace the holddown bars 30A of FIG. 1 as will be apparent hereinafter whereby this copending patent application, Ser. No. 412,416, filed Aug. 27, 1982 is being incorporated into this disclosure by this reference thereto. However, sufficient details of the holddown bars of such copending application will now be described in this application in order to fully understand the improved features of this invention.

In particular, the holddown bars 70 and 70A respectively have opposed ends 71, 72 and 71A, 72A integrally and respectively interconnected together by medial portions 73 and 73A, the medial portions 73 and 73A, as well as at least part of the respective opposed ends 71, 72 and 71A, 72A, being so constructed that the same define channels 74 and 74A therein that receive the resilient sealing gaskets 75 and 75A which are disposed between pairs of spaced apart substantially parallel legs 76 and 76A.

The holddown bars 70 and 70A are made from a relatively rigid polymeric material and are formed, such as by molding, so that the opposed ends 71, 72 and 71A, 72A, as well as the medial portions 73 and 73A thereof, respectively comprise one-piece members that form the unique configurations illustrated in the drawings.

In particular, the medial portions 73 and 73A of the holddown bars 70 and 70A are substantially straight with the top portions 78 and 78A thereof each having a substantially trapezoidal cross-sectional configuration so as to provide substantially streamlined top surfaces 79 and 79A of the respective holddown bars 70 and 70A, as well as added strength to the medial portions 73 and 73A thereof.

Figure 8:
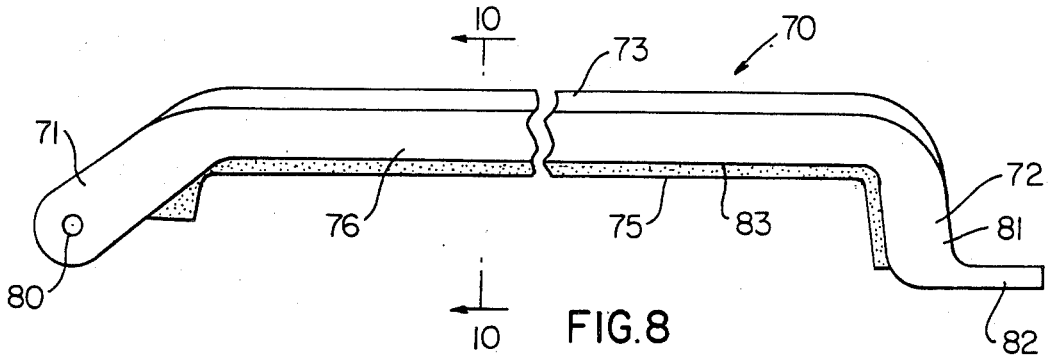
FIG. 8 is a side view of the holddown bar of FIG. 7.
Figure 9:
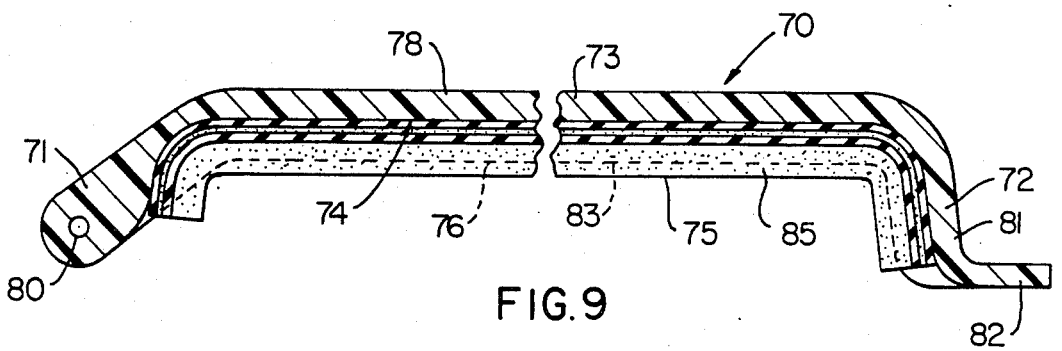
FIG. 9 is a cross-sectional view taken on line 9—9 of FIG. 7.
Figure 11:
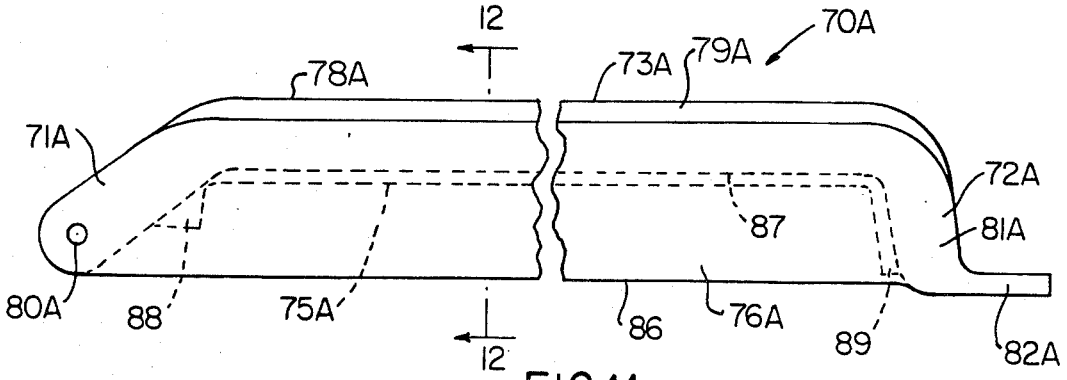
FIG. 11 is a side view of another improved prior known holddown bar of the invention of the aforementioned copending patent application.

The ends 71 and 71A of the respective holddown bars 70 and 70A are substantially straight and are respectively disposed at obtuse angles relative to the respective medial portions 73 and 73A as illustrated respectively in FIGS. 8 and 11.

In this manner, the ends 71 and 71A of the holddown bars 70 and 70A respectively have the same width as the pair of legs 76 and 76A as well as provide relatively large masses of material to have the respective pivot holes 80 and 80A passing therethrough for respectively receiving the pivot pins 42 of the brackets 43 of the railroad car 32 when the same are utilized to replace the holddown bars 30 and 30A as previously described.

Figure 7:
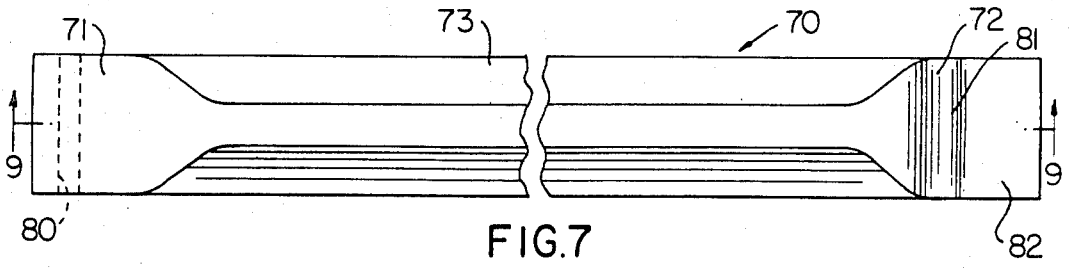
FIG. 7 is a top view of the holddown bar of FIG. 6.

The other ends 72 and 72A of the respective holddown bars 70 and 70A are substantially L-shaped and are defined by a pair of legs 81, 82 and 81A, 82A that join each other substantially at a right angle while the legs 81 and 81A respectively join the medial portions 73 and 73A substantially at right angles as illustrated respectively in FIGS. 8 and 11. The ends 72 and 72A are substantially the same width as the ends 71 and 71A previously described whereby the overall top view configurations of the holddown bars 70 and 70A of that invention are substantially rectangular as illustrated in FIG. 7.

Figure 10:
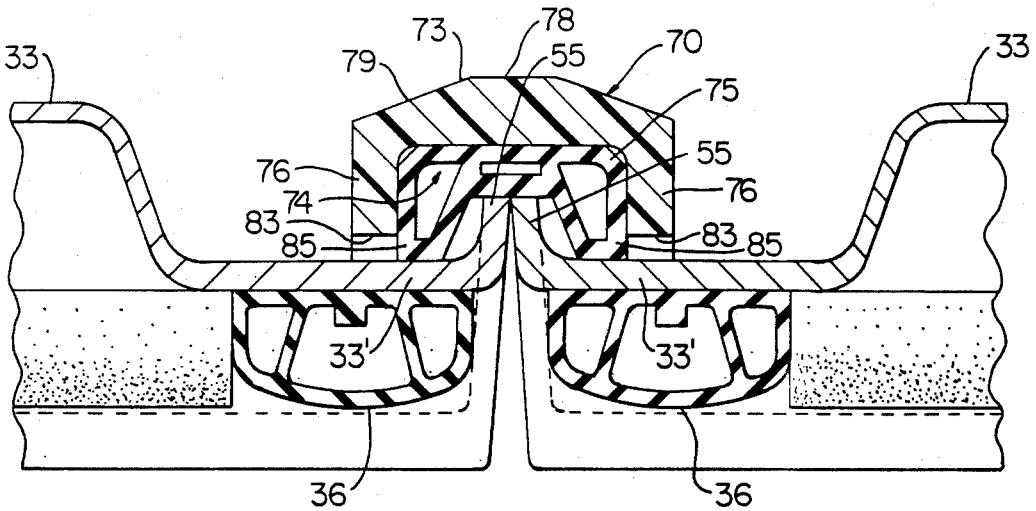
FIG. 10 is an enlarged fragmentary cross-sectional view taken on line 10—10 of FIG. 8 and illustrates the holddown bar in combination with hatch covers in a manner similar to FIG. 4.
Figure 12:
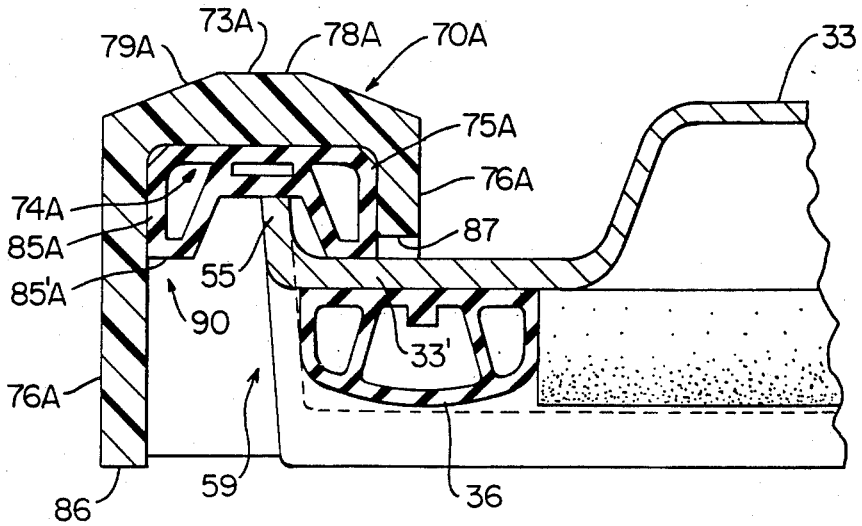
FIG. 12 is an enlarged fragmentary cross-sectional view taken on line 12—12 of FIG. 11 and illustrates the holddown bar in combination with a hatch cover in a manner similar to FIG. 5.

As illustrated in FIG. 10, the legs 76 of the holddown bar 70 respectively have bottom edges 83 which are disposed substantially coplanar with each other while the side portions 85 of the gasket 75 extend outboard of the end edges 83 whereas in contrast the bottom edges 86 and 87 of the legs 76A of the holddown bar 70A are disposed in offset relation so that the bottom edge 86 of the longer leg 76A will extend closely adjacent the hatch opening flange 37 of the railroad car 32 as illustrated in FIG. 12 to protect the end area 59 of the adjacent end 33' of the hatch cover 33 in a believed to be more effective manner than the side plate 57 of the holddown bar 30A previously described whereby the longer leg 76A comprises a "rain shield".

In particular, it can readily be seen in FIG. 11 that the longer leg 76A has its bottom edge 86 disposed so that the same fully protects the opposed end portions 88 and 89 of the gasket 75A whereas it can readily be seen in FIG. 3 that the opposed ends 60 and 61 of the gasket 52A are exposed to the elements below the bottom edge 58 of the side plate 57 thereof.

In addition, it can readily be seen in FIG. 12 that the longer leg 76A of the holddown bar 70A is fully disposed against the sealing gasket 75A all the way to the bottom edge 85'A of the adjacent portion 85A thereof so that wind, dirt, sleet, etc. cannot enter between the longer leg 76A and the gasket 75A in the region of the reference numeral 90 whereas in contrast it can readily be seen in FIG. 5 that wind, dirt, sleet, etc. can enter into the region indicated by the reference numeral 62 to attack the lower free end 53A of the sealing gasket 52A to begin a tear area therein as previously described.

As previously stated, the holddown bars 70 and 70A can be formed from any suitable relatively rigid polymeric material that can be molded into the configurations illustrated and the gaskets 75 and 75A can be subsequently and respectively adhesively secured in the channels 74 and 74A to perform a sealing function with the flanges 55 of the hatch covers 33 as well as against points thereon inboard of the flanges 55 as illustrated respectively in FIGS. 10 and 12.

For example, the relatively rigid polymeric material for forming the holddown bars 70 and 70A can be an ultra high molecular weight synthetic plastic material, such as nylon, polyethylene, urethane, etc., having a molecular weight of between two million and six million. For example, such an ultra high molecular weight polyethylene material and a method of molding the same is disclosed in the U.S. Pat. No. 4,238,039 to Cooper et al, whereby this patent is being incorporated into this disclosure by this reference thereto. Also, such polymeric material for the holddown bars 70 and 70A could be reinforced, such as is disclosed in this patent to Cooper et al or in the manner set forth in the copending patent application, Ser. No. 456,154, filed Jan. 6, 1983, and now U.S. Pat. No. 4,602,568 whereby this copending patent application is being incorporated into this disclosure by this reference thereto.

Accordingly, it can be seen that it is a relatively simple method to form the holddown bars 70 and 70A, such as by a simple molding operation, so that the same are substantially one-piece members that readily replace the holddown bars 30 and 30A of the railroad car 32 illustrated in FIG. 1 as the ends 71 and 71A thereof readily permit the same to be pivotally mounted on the pivot pins 42 of the brackets 43 and the legs 82 and 82A of the ends 72 and 72A readily accept the latches 46 to permit latching of the holddown bars 70 and 70A with their medial portions 73 and 73A extending across the hatch covers 33 in such a manner that the sealing gaskets 75 and 75A thereof will seal and hold against the hatch covers 33 so that their respective sealing gaskets 36 will readily seal against the hatch opening flange 37 in the manner previously described.

However, it has been found that the holddown bars 70 and 70A are approximately sixty percent lighter than their steel counterparts 30 and 30A whereby a weight gain advantage of approximately 35 pounds per railroad car 32 is provided when the holddown bars 70 and 70A are substituted for the holddown bars 30 and 30A and such railroad car 32 had two holddown bars 30A and three holddown bars 30.

It is also believed that the holddown bars 70 and 70A are four times more wear resistant than the stainless steel counterpart holddown bars 30 and 30A.

Since the holddown bars 70 and 70A have less weight than their steel counterparts 30 and 30A, it is believed that the holddown bars 70 and 70A will not overload their respective gaskets 75 and 75A, as well as the gaskets 36 of the hatch covers 33, so as to permit the gaskets to maintain their sealing resilience for a longer period of time.

In addition to the chemical resistance and no-rust properties of the polymeric material of the holddown bars 70 and 70A, the polymeric material thereof is compatible with the plastic material that normally forms the hatch covers 33. This is particularly important because it has been found that as railroad cars 32 vibrate, twist and torque, the weight and pressure of a steel holddown bar, with its alien physical properties, can cause undue wear and cracks in the hatch covers 33. Since hatch cover replacements are costly, it is believed that by utilizing the holddown bars 70 and 70A, since the same have substantially the same expansion, contraction and mechanical characteristics as the hatch covers 33, a major source of stress and wear on the hatch covers 33 will be eliminated.

Since the operation of the holddown bars 70 and 70A are substantially the same as the holddown bars 30 and 30A previously described, it is deemed unnecessary to further describe the operation of the holddown bars 70 and 70A except to state that same can readily replace the holddown bars 30 and 30A.

When the holddown bars 70 and 70A are formed of the aforementioned ultra high molecular weight nylon, and such material was presently the preferred material for the holddown bars 70 and 70A, such material will provide the following characteristics among others; high tensile strength for structural rigidity; maintains its strength over a wide temperature range; heat distortion only occurs at temperatures over 400° F.; has outstanding wear resistance; is approximately seven times lighter than most metals; has excellent chemical resistance; has self-extinguishing flamability characteristics; is ultraviolet resistant; is self-lubricating, such as in the hinge area that is indicated by the reference numerals 42, 43 in FIG. 1; does not rust; and provides no damage to the running boards of the railroad car 32 which are indicated by the reference numeral 91 in FIG. 1.

Therefore, it can be seen that each of the holddown bars of the aforementioned copending patent applications can comprise a one-piece member formed of relatively rigid polymeric material and having or not having reinforcing therein as desired.

The holddown bars 70 and 70A previously described and illustrated in FIGS. 6–12, can have various modifications therein for various purposes. For example, the channels 74 and 74A thereof could be modified to provide other means for securing the gaskets 75 and 75A therein rather than relying solely on an adhesive securement thereto.

For example, reference is now made to FIGS. 13–16 wherein other holddown bars of the invention of the copending patent application, Ser. No. 412,416, filed Aug. 27, 1982, are respectively generally indicated by the reference numerals 70B, 70C, 70D, and 70E with parts thereof similar to the holddown bars 70 previously described being indicated by like reference numerals followed by the respective reference letter "B", "C", "D", and "E" with the understanding that either of the legs thereof could be extended to provide protection for the exposed end 33' of a hatch cover 33 in the same manner as the longer leg 76A of the holddown bar 70A previously described.

Figure 13:
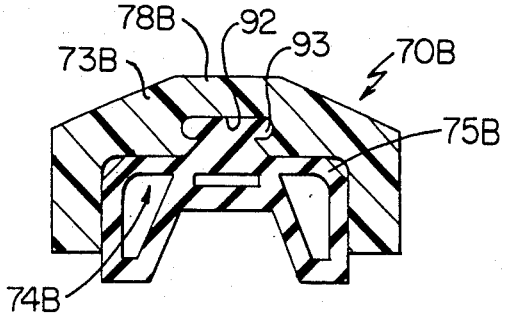
FIG. 13 is a cross-sectional view of another holddown bar of the invention of the aforementioned copending patent application.

As illustrated in FIG. 13, the holddown bar 70B is provided with a longitudinal locking groove 92 in the cross part 78B of the medial portion 73B thereof to receive a locking longitudinal protrusion 93 of the gasket 75B to mechanically secure the gasket 75B in the channel 74B of the holddown bar 70B.

Figure 14:
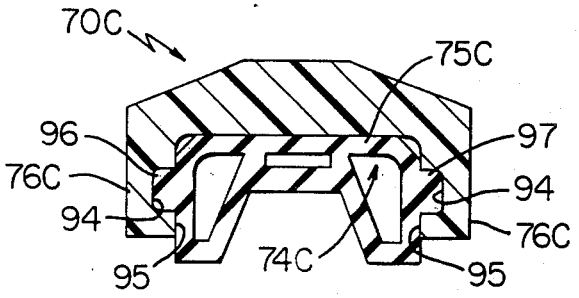
FIG. 14 is a view similar to FIG. 13 and illustrates another holddown bar of that invention.

As illustrated in FIG. 14, the holddown bar 70C has longitudinal grooves 94 respectively formed in the facing sides 95 of the depending legs 76C thereof to repsectively receive outwardly extending longitudinal protrusions 96 and 97 on the gasket 75C in order to mechanically secure the gasket 75C in the channel 74C of the holddown bar 70C.

Figure 15:
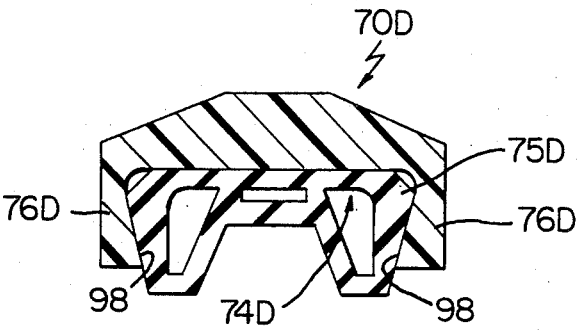
FIG. 15 is a view similar to FIG. 13 and illustrates another holddown bar of that invention.

As illustrated in FIG. 15, the depending legs 76D respectively have inside facing surfaces 98 that are angled relative to each other so that the resulting channel 74D in the holddown bar 70D is dovetailed and will cause the gasket 75D to be wedged between the legs 76D as illustrated in FIG. 15 to mechanically hold the gasket 75D in the channel 74D.

Figure 16:
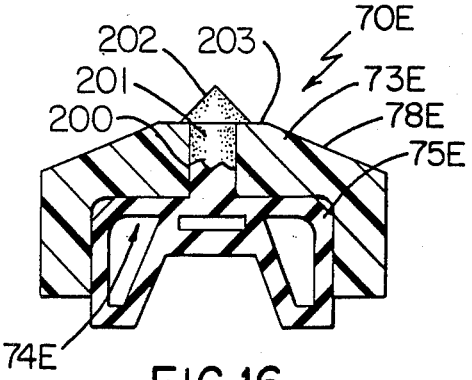
FIG. 16 is a view similar to FIG. 13 and illustrates another holddown bar of that invention.

As illustrated in FIG. 16, the cross portion 78E of the holddown bar 70E can have a plurality of spaced apart openings 200 passing vertically therethrough and respectively receiving protrusions 201 of the gasket 75E that respectively have enlargements 202 that will snap through the openings 200 and bear against the top surface 203 of the medial portion 73E of the holddown bar 70E in order to mechanically secure the gasket 75E in the channel 74E thereof. Of course, the medial portion 73E of the holddown bar 70E could be provided with an elongated slot 200 throughout the longitudinal length thereof to receive a longitudinal projection 201, if desired.

Therefore, it can be seen that in addition to or in lieu of adhesively securing the gasket in the channel of the holddown bar of the invention of the copending patent application, Ser. No. 412,416, filed Aug. 27, 1982, the holddown bar thereof can be modified in order to mechanically secure the gasket in the channel thereof. It is also stated that the holddown bar of that invention could be molded around the rubber gasket so as to be secured to the same or two dissimilar polymeric materials could be molded together, one for the structural member and one for the gasket.

However, it is believed according to the teachings of this invention that the adhesive that secures the gasket in any of the previously described holddown bars should be mechanically interlocked to the holddown bar so that the adhesive would more readily be carried by the holddown bar as it is believed that while the adhesive readily bonds to the rubber gasket, the adhesive does not readily bond to the particular polymeric material of the holddown bar.

Figure 17F:
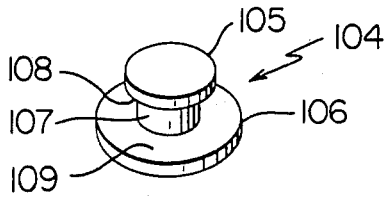
FIG. 17F is a perspective view of one of the interlocking members of this invention utilized in the holddown bar of FIG. 17.
Figure 17:
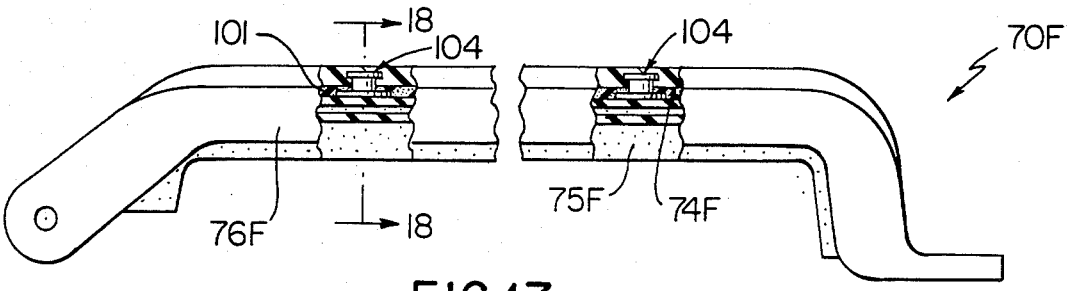
FIG. 17 is a side view, partially shown in cross section, illustrating an improved holddown bar of this invention.
Figure 18:
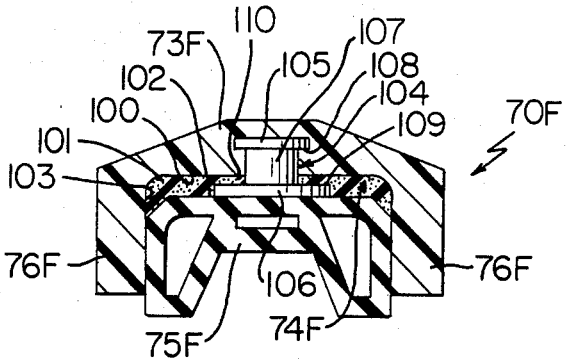
FIG. 18 is an enlarged cross-sectional view taken on line 18—18 of FIG. 17.

In particular, an improved holddown bar of this invention is generally indicated by the reference numeral 70F in FIGS. 17 and 18 and parts thereof similar to the holddown bars 70, 70A, 70B, 70C, 70D and 70E previously described are indicated by like reference numerals followed by the reference letter capital "F".

As illustrated in FIGS. 17 and 18, the holddown bar 70F is substantially the same as the holddown bar 70 previously described with the channel 74F between the adjacent legs 76F defining a substantially flat surface 100 against which the adhesive 101 is disposed to not only secure against the surface 100, but also to secure against the surface 102 of the gasket 75F also disposed in the channel 74F as illustrated in FIGS. 17 and 18.

While the adhesive 101 can be any suitable adhesive, the same can be a rubber-based adhesive such as a plastisol or be an epoxy resin which readily adheres to the surface 102 of the rubber gasket 75F but may not be compatible with the polymeric material of the holddown bar 70F which defines the surface 100 thereof as well as the adjacent surface 103 of the adjacent legs 76F of the holddown bar 70F.

Therefore, the holddown bar 70F of this invention utilizes a plurality of interlocking members 104 spaced along the channel 74F and each formed of metal or any other suitable material and having a first part 105 interlocked to the polymeric material of the medial portion 73F of the holddown bar 70F and a second part 106 that mechanically interlocks with the adhesive 101, the parts 105 and 106 being interconnected together by a reduced intermediate portion 107 of the interlocking member 104.

In this manner, it can readily be seen in FIG. 17F that each interlocking member 104 is substantially spool-shaped with the parts 105 and 106 being substantially circular discs while the intermediate portion 107 comprises a substantially cylindrical portion that has a diameter substantially less than the diameters of the disc portions 105 and 106, the disc portion 106 having a larger diameter than the portion 105, if desired. In any event, it can be seen that parts 105 and 106 of each interlocking member 104 have facing sides 108 and 109 which provide an interlocking function therefor.

For example, when the polymeric material of the holddown bar 70F is being molded to form the holddown bar 70F in the configuration illustrated, the interlocking members 104 are molded therein so that the part 105 of each member 104 is molded into the polymeric material of the medial portion 73F of the resulting holddown bar 70F in such a manner that the intermediate part or portion 107 thereof extends out of the surface 100 so that the surface 109 of the interlocking part 106 will be spaced from the surface 100 by a certain amount as illustrated in FIG. 18.

In this manner, when the adhesive 101 is subsequently disposed in the channel 74F against the surface 100 of the holddown bar 70F, a substantial portion of the adhesive 101 that is indicated by the reference numeral 110 in FIG. 18 is trapped between the surface 100 of the holddown bar 70F and the surface 109 of the interlocking part 106 of the interlocking member 104 so that when the adhesive 101 subsequently solidifies, the part 110 of the adhesive 101 is mechanically interlocked to the respective interlocking member 104 while the respective interlocking member 104 has its surface 108 mechanically interlocked to the polymeric material of the holddown bar 70F in the manner previously described.

Accordingly, it is believed that the adhesive 101 for the holddown bar 70F of this invention will more readily secure the gasket 75F in the channel 74F as the adhesive 101 readily bonds to the surface 102 of the sealing gasket 75F and while the adhesive 101 will bond to the surface 100 of the holddown bar 70F to a certain degree, the adhesive 101 is additionally mechanically interlocked to the surface 100 of the holddown bar 70F by the interlocking inserts 104 in the manner previously described to prevent the gasket 75F from being subsequently pulled out of the channel 74F.

Therefore, it can be seen that it is a relatively simple method of this invention to make the holddown bar 70F of this invention by merely molding the interlocking inserts 104 of this invention in the polymeric material of the holddown bar 70F as the holddown bar 70F is being initially molded from its polymeric material so that the interlocking parts 105 of each insert 104 is interlocked to that polymeric material while the intermediate portion 107 thereof extends out of the resulting surface 100 so as to space the surface 109 of the interlocking part 106 therefrom to subsequently trap or interlock the portion 110 of the adhesive 101 in the channel 74F when the adhesive 101 is subsequently disposed in the channel 74F against the surface 100 of the holddown bar 70F. Of course, the gasket 75F is disposed in the channel 74F before the adhesive means 101 solidifies so that the adhesive 101 will adhere to the surface 102 thereof as illustrated in FIGS. 17 and 18.

While the interlocking part 105 of the interlocking member 104 of this invention has been previously illustrated and described as being substantially circular in configuration, it is to be understood that the same can be other than circular in order to prevent rotational movement of the same in the polymeric material of the holddown bar 70F after the same has been molded therein in the manner previously described.

Figure 19:
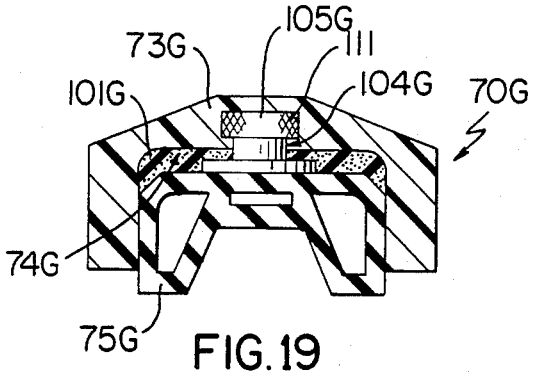
FIG. 19 is a view similar to FIG. 18 and illustrates another embodiment of the holddown bar of this invention.

For example, such an improved holddown bar of this invention is generally indicated by the reference numeral 70G in FIG. 19 and parts thereof similar to the holddown bar 70F previously described are indicated by like reference numerals followed by the reference letter "G".

As illustrated in FIG. 19, it can be seen that the holddown bar 70G is substantially the same as the holddown bar 70F previously described and that the gasket 75G is substantially the same as the gasket means 75F previously described and is secured in the channel 74G by the adhesive 101G in the manner previously described.

Also, it can be seen that each interlocking insert 104G has substantially the same configuration as the insert 104 previously described except that the interlocking part 105G thereof that is disposed within the polymeric material of the holddown bar 70G is provided with a knurled or serrated external peripheral surface 111 which itself mechanically interlocks with the polymeric material of the medial portion 73G of the holddown bar 70G so as to tend to prevent rotation of the insert 104G in its molded in condition as illustrated in FIG. 19.

While only one insert 104G is illustrated in FIG. 19, it is to be understood that the holddown bar 70G can have one or more inserts 104G in the same manner as the holddown bar 70F previously described.

Figure 20H:
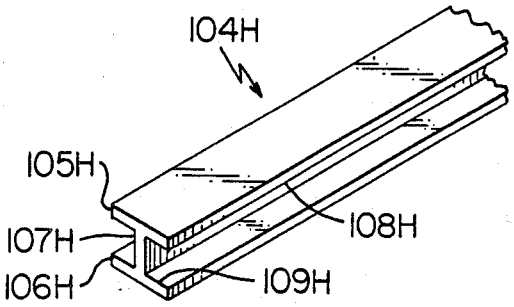
FIG. 20H is a fragmentary perspective view of the interlocking member of this invention utilized in the holddown bar of FIG. 20.
Figure 20:
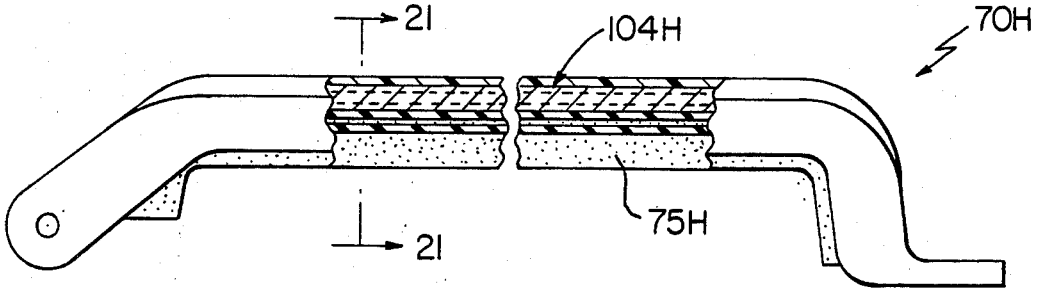
FIG. 20 is a view similar to FIG. 17 and illustrates another embodiment of the holddown bar of this invention.
Figure 21:
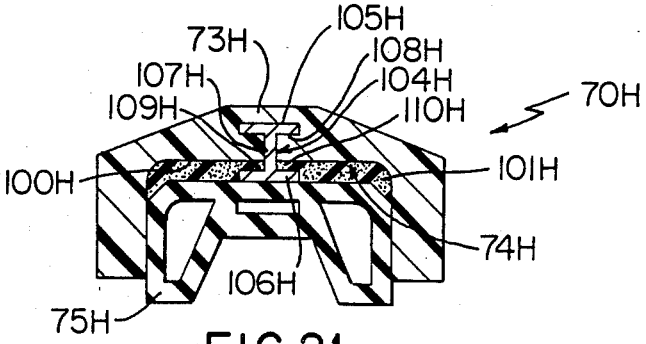
FIG. 21 is an enlarged cross-sectional view taken on line 21—21 of FIG. 20.

Another holddown bar of this invention is generally indicated by the reference numeral 70H in FIGS. 20 and 21 and parts thereof similar to the holddown bars 70F and 70G previously described are indicated by like reference numerals followed by the reference letter "H".

As illustrated in FIGS. 20 and 21, it can be seen that the holddown bar 70H is substantially the same as the holddown bar 70F previously described except that another type of interlocking member of this invention is provided and the same is generally indicated by the reference numeral 104H.

As illustrated in FIGS. 20, 20H and 21, the insert or interlocking member 104H of this invention comprises a substantially I-beam structure formed of metal or any other suitable material and having a pair of like substantially flat rectangular interlocking parts 105H and 106H spaced apart by a substantially flat narrow intermediate portion 107H.

In this manner, during the molding of the holddown bar 70H, the I-beam interlocking member 104H is molded in the polymeric material so that the interlocking part 105H is molded in the medial portion 73H of the resulting holddown bar 70H with the intermediate portion 107H thereof projecting out of the flat surface 100H of the holddown bar 70H that defines the channel 74H in the manner previously described whereby the facing side 109G of the interlocking part 106H is disposed spaced from the surface 100H to provide a means for capturing the portion 110H of the adhesive 101H therein when the adhesive 101H is subsequently disposed in the channel 74H against the surface 100H in the same manner as the adhesive 101 previously described.

Therefore, it can be seen that the facing sides 109H and 108H of the respective interlocking parts 106H and 105H of the interlocking member 104H mechanically interlocks respectively with the adhesive 101H and the polymeric material of the holddown bar 70H in the manner previously described so that the interlocking member 104H of this invention assures that the adhesive 101H will positively secure the sealing gasket 75H in the channel 74H of the holddown bar 70H in the manner previously described.

Therefore, it can be seen that in each of the embodiments of the holddown bar of this invention, an interlocking member is provided for the holddown bar to be carried thereby and has a first part thereof mechanically interlocking to the holddown bar and a second part thereof mechanically interlocking to the adhesive to thereby mechanically interlock the adhesive to the holddown bar so that the gasket is secured within the resulting channel of the holddown bar in a manner believed to be more effective than the securement of the gasket therein that is provided by the holddown bars of the aforementioned copending patent application, Ser. No. 412,416, filed Aug. 27, 1982.

Therefore, it can be seen that this invention not only provides an improved holddown bar for a railroad car or the like and a method of making the same, but also this invention provides a railroad car utilizing such a holddown bar.

While the forms and methods of this invention now preferred have been illustrated and described as required by the Patent Statute, it is to be understood that other forms and method steps can be utilized and still fall within the scope of the appended claims.

What is claimed is:

1. In a method of making a holddown bar for a hatch cover of a railroad car, said method comprising the steps of molding said holddown bar from polymeric material so as to have opposed ends one of which is adapted to be pivotally mounted to said car and the other of which is adapted to be releasably latched to said car while a medial portion thereof intermediate said opposed ends is adapted to extend across said hatch cover and carry a sealing gasket means in a channel means thereof that engages against said hatch cover, forming said channel means to be defined by a surface means of said holddown bar, disposing adhesive means in said channel means, and then securing said gasket means to said surface means with said adhesive means that is disposed between said surface means and said gasket means, the improvement comprising the steps of forming interlocking means to be carried by said holddown bar, mechanically interlocking a first part of said interlocking means to said holddown bar by molding said first part in said holddown bar as said holddown bar is being molded, and then mechanically interlocking a second part of said interlocking means to said adhesive means when said adhesive means is being disposed in said channel means to thereby mechanically interlock said adhesive means to said holddown bar.

2. A method as set forth in claim 1 and including the step of forming said interlocking means to have an intermediate portion thereof interconnected to said first and second parts thereof and spacing said first and second parts from each other.

3. A method as set forth in claim 2 and including the steps of disposing said intermediate portion of said interlocking means to extend out of said surface means to space said second part from said surface means, and disposing said adhesive means to have a portion thereof disposed between said surface means and said second part so that said portion of said adhesive means is interlocked between said surface means and said second part.

4. A method as set forth in claim 3 and including the step of forming said interlocking means to comprise a plurality of like members spaced from each other along said channel means and each having said first and second parts interconnected together by said intermediate portion.

5. A method as set forth in claim 3 and including the step of forming said interlocking means to comprise an elongated member having a substantially I-beam cross-sectional configuration.

6. A method as set forth in claim 3 and including the step of molding said first part of said interlocking means in said holddown bar in a spaced manner from said surface means thereof so that a portion of said holddown bar is disposed between said surface means and said first part and thereby interlocks said first part to said holddown bar.

* * * * *